United States Patent [19]

Morrison

[11] 4,320,986

[45] Mar. 23, 1982

[54] MOTOR POWERED ROTARY TROWEL

[76] Inventor: Donald R. Morrison, 2109 Camp Green St., Charlotte, N.C. 28208

[21] Appl. No.: 132,636

[22] Filed: Mar. 21, 1980

[51] Int. Cl.[3] ..... E01C 19/22

[52] U.S. Cl. ..... 404/112; 425/445

[58] Field of Search ..... 404/112

[56] References Cited

U.S. PATENT DOCUMENTS

| | | | |
|---|---|---|---|
| 2,342,445 | 2/1944 | Allen | 404/112 |
| 2,351,278 | 6/1944 | Mathews | 404/112 |
| 2,434,408 | 1/1948 | Huffman | 404/112 |
| 2,826,971 | 3/1958 | Stevens | 404/112 |
| 3,062,107 | 11/1962 | Mitchell | 404/112 |
| 3,296,946 | 1/1967 | Cagno | 404/112 |
| 3,375,766 | 4/1968 | Zochil | 404/112 |
| 3,402,647 | 9/1968 | Colizza | 404/112 X |
| 3,412,657 | 11/1968 | Colizza | 404/112 |
| 3,459,109 | 8/1969 | Ingleright | 404/112 X |
| 4,046,484 | 9/1977 | Holz | 404/112 |

*Primary Examiner*—Nile C. Byers, Jr.
*Attorney, Agent, or Firm*—B. B. Olive

[57] ABSTRACT

A motor powered rotary trowel employs a plurality of radially arranged trowel blades which can be adjustably tilted on their support arms in either direction and are mounted on a drive shaft which can be driven in either direction thereby enabling the weight of the trowel to be selectively supported on the edges on one side or the other of the trowel blades. In an alternative embodiment, selected parts of the trowel are arranged to fold to facilitate transport.

7 Claims, 14 Drawing Figures

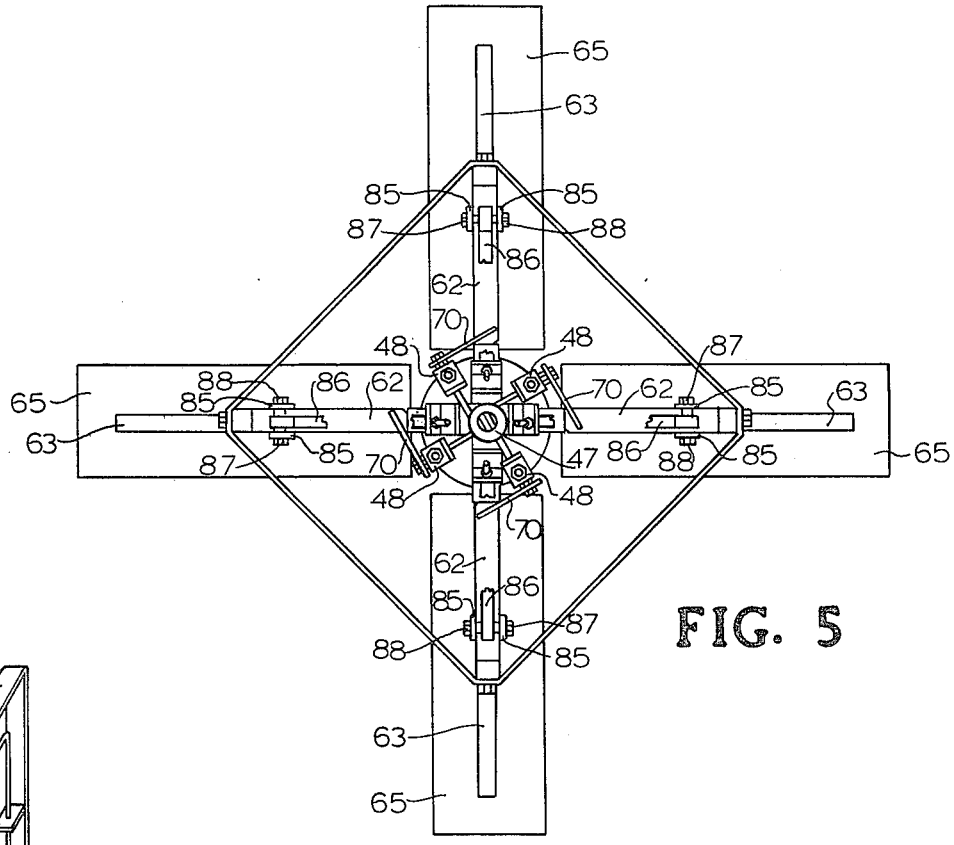
FIG. 5
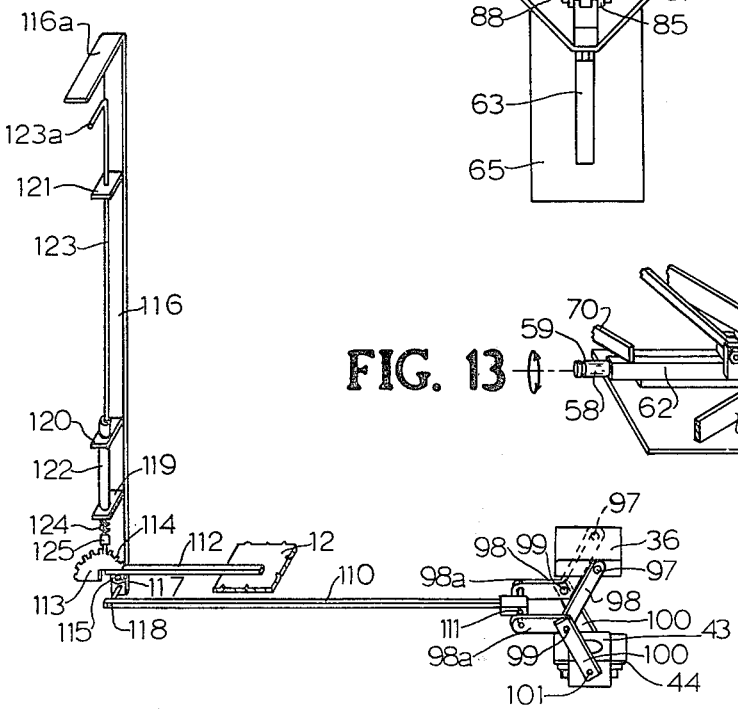
FIG. 6
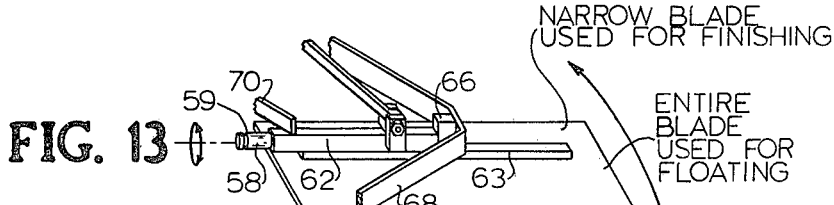
FIG. 13
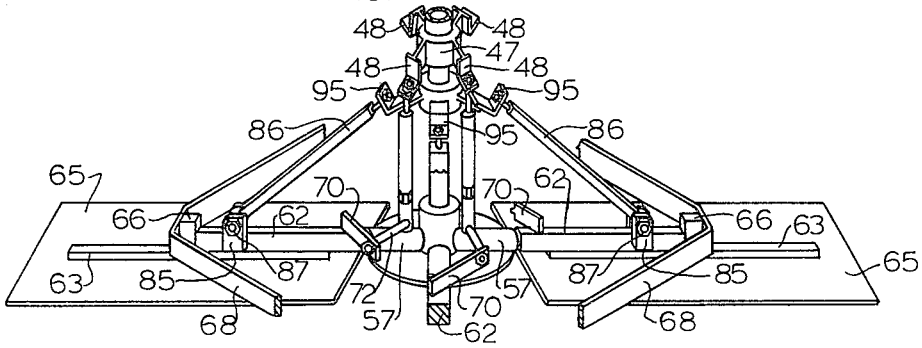

MOTOR POWERED ROTARY TROWEL

BACKGROUND OF THE INVENTION

1. Field of the Invention

The invention relates to motor powered trowels for smoothing concrete.

2. Description of the Prior Art

It is known to be desirable to incorporate means in a power operated trowel enabling the blades to be tilted relative to the work surface to vary the blade action, for example, from a finishing action to a floating action or vice versa. U.S. Pat. Nos. 2,351,278 and 3,412,657 teach, for example, mechanical arrangements for adjusting the blade tilt whereas U.S. Pat. Nos. 2,826,971 and 3,062,107, by way of example, illustrate blade tilting apparatus using hydraulic mechanisms.

The ability to mechanically or hydraulically adjust the blade tilt provides the important advantage of being able to conduct both finishing and floating operations with the same blades by adjusting the tilt of the blades according to whether a finishing or floating action is desired. However, blades tend to wear very quickly because of the abrasive action between the blade surfaces and the concrete work surface. In some situations and depending on what type of action is required, i.e., floating or finishing, the blades can be reversed so that the original leading edges become the trailing edges of the blades and vice versa. However, substantial time is required to remove and replace or re-orient the blades.

As another aspect of motor powered trowel construction according to present practices, the set of trowel blades are always rotated in the same direction. The previously-mentioned prior art patents illustrate this unidirectional characteristic of motor powered trowels of the type having one set of trowel blades whereas U.S. Pat. Nos. 3,936,212 and 4,046,484 illustrate motor powered trowels having two or three sets of trowel blades but with each set always turning in the same direction. Thus, the blades, once mounted on their respective mounting arms, can only be rotated in one direction around the vertical drive shaft axis whereas the present invention recognizes that it would be desirable to have means enabling the set of blades to be rotated in either direction about the vertical drive axis as well as having means enabling the blades to be tilted in either direction around the radial horizontal axis of the respective mounting arms on which the blades are mounted in the typical motor powered trowel.

One of the most popular types of motor powered trowels is the type having only one set of trowel blades, as illustrated for example in U.S. Pat. No. 2,351,278, in contrast to a motor powered trowel having plural sets of blades as illustrated, for example, in U.S. Pat. No. 3,936,212. Since the motor powered trowel apparatus needs to be frequently moved from job site to job site, the ease of transport becomes an important consideration. In this regard, it is often desirable to have a motor powered trowel in which the overall diameter of the set of blades exceeds the width of the bed in the typical pickup truck. Thus, it would be desirable to have a motor powered trowel with a relatively large blade span but which could be folded for ease of transport in the bed of an ordinary pickup truck. Thus, the present invention has among other objects that of providing a motor powered trowel having means enabling the blades to be tilted in either direction as well as means enabling the blades to be rotated about the vertical drive axis in either direction together with means enabling the trowel structure to be folded for ease of transport. These and other objects will become apparent as the description proceeds.

SUMMARY OF THE INVENTION

A motor powered rotary trowel is illustrated in the preferred embodiment as employing a set of four trowel blades mounted on radially arranged arms and with a lever arrangement enabling the blades to be titled in either direction so that the weight of the trowel can be supported on either set of trowel blade edges. Power is supplied by a gasoline engine which in turn powers a reversible hydraulic motor coupled to the drive shaft which rotates the set of trowel blades thereby enabling the blades to be rotated around the axis of th drive shaft in either direction and in correspondence with the blades being tilted on their respective arms at some predetermined angle of tilt appropriate to a desired finishing or floating action. Means are also provided for individually adjustably bracing each of the arms on which the blades are mounted so as to compensate for variations in construction as well as for adjustments required because of the blades striking some unexpected object embedded in the concrete being smoothed. Provision is also made in one embodiment of the invention for folding portions of the trowel apparatus for ease of transport.

While illustrated primarily as applied to a motor powered trowel having only a single set of blades, the invention apparatus also finds application in those types of powered trowels having two or more sets of trowel blades and such application is also dealt with in the description.

DESCRIPTION OF THE DRAWINGS

FIG. 5 is a fragmentary, section view taken substantially along line 5—5 of FIG. 3.

FIG. 6 is a fragmentary, partially exploded, perspective view of the trowel blade tilting mechanism.

FIG. 13 is a fragmentary perspective view illustrating how a combination float-finish type blade finds use with the invention.

DESCRIPTION OF THE PREFERRED EMBODIMENT

Figure 1:
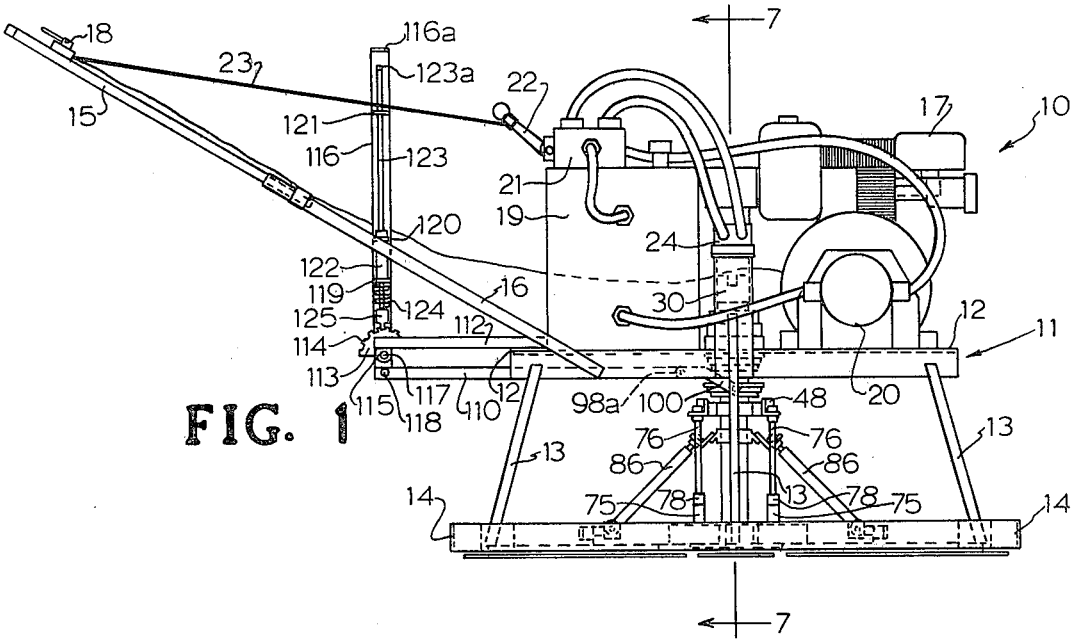
FIG. 1 is a side elevation view of a troweling machine in accordance with the preferred first embodiment of the invention.

Referring initially to FIGS. 1–10, a troweling machine 10 in accordance with the present invention has a frame 11 with a mounting plate 12, ribs 13, and guard ring 14. For transportation purposes, handle 15 is arranged so that it can be telescoped inward the lower portion of supporting channel members 16. Handle 15 has appropriate remote operating controls 18 for the gasoline engine 17 which serves as a source of power for driving the trowel apparatus of the invention.

Figure 2:
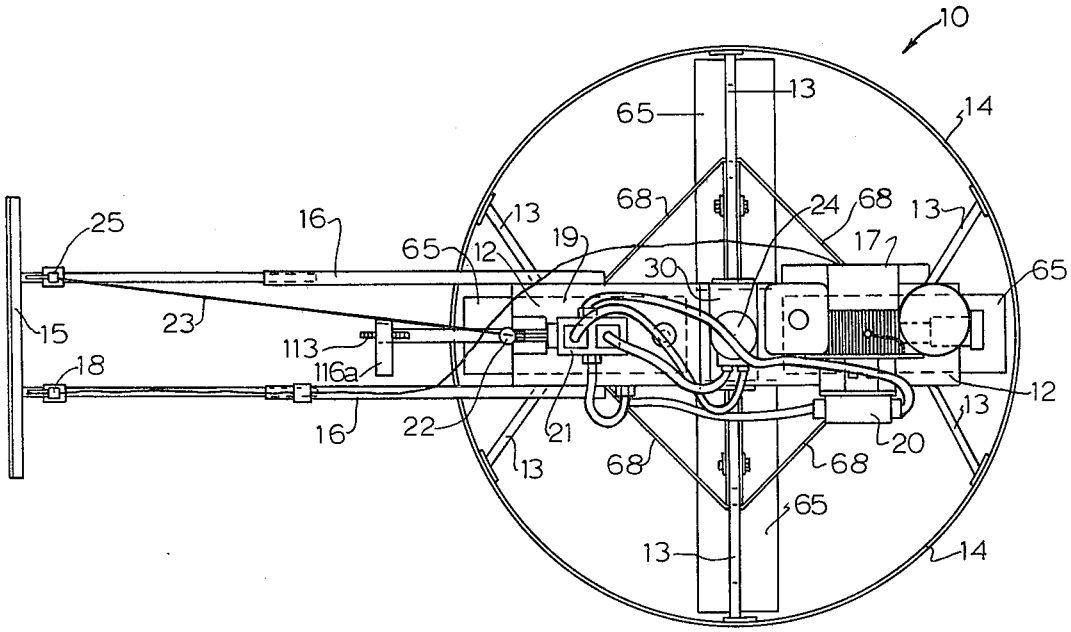
FIG. 2 is a top plan view of the troweling machine of FIG. 1.
Figure 3:
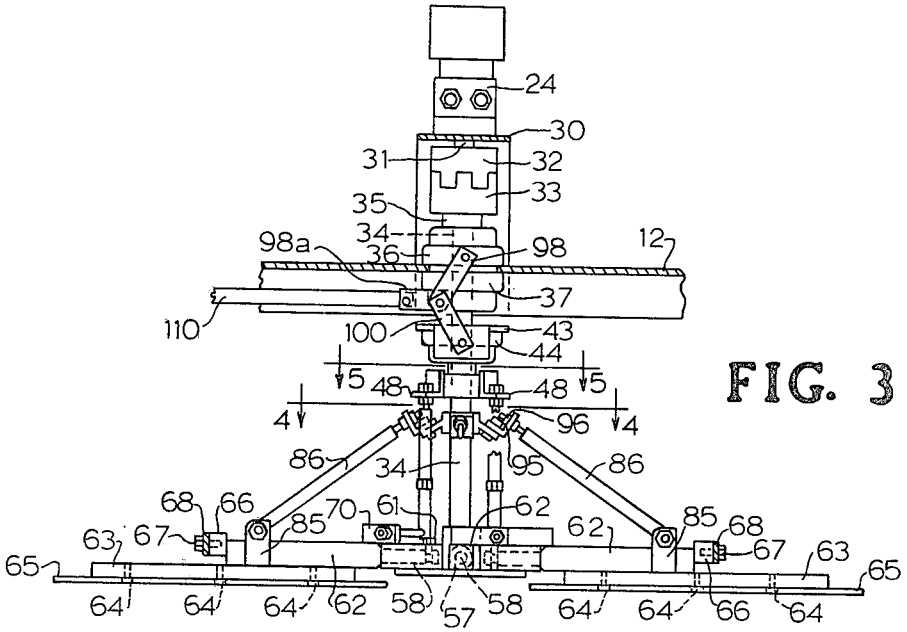
FIG. 3 is an enlarged, fragmentary, side elevation view of the drive and pivoting mechanism for the troweling blades.
Figure 4:
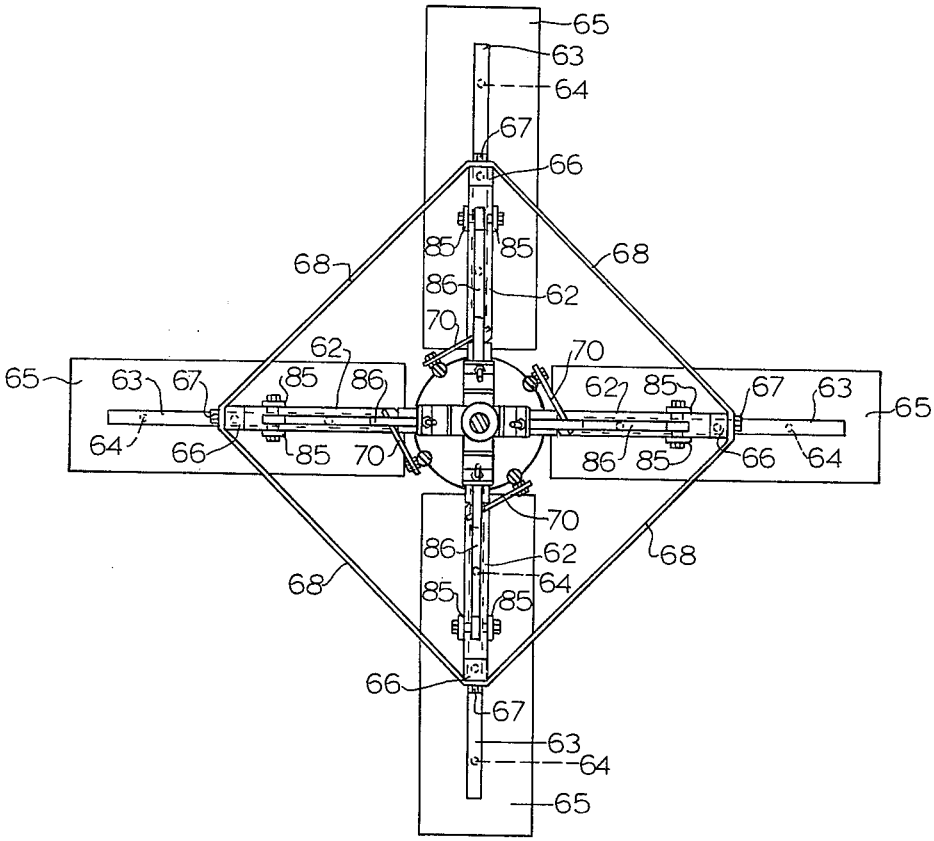
FIG. 4 is a fragmentary, section view taken substantially along line 4—4 of FIG. 3.

Mounting plate 12 provides the mounting for engine 17 which is rigidly secured thereto at the end of frame 11 opposite handle 15. Also mounted on plate 12 is hydraulic reservoir 19. Reservoir 19 is rigidly secured to plate 12 at the end of frame 11 adjacent handle 15 and opposite engine 17. Unlike the typical troweling machine having a single set of troweling blades in which the drive engine is located centrally of the blades, the present invention takes advantage of the weight of reservoir 19 by locating engine 17 and reservoir 19 in opposite positions to achieve a balancing effect which is particularly desirable in the troweling of soft or wet concrete. Hydraulic pump 20 is positioned adjacent and is driven by engine 17. A conventional hydraulic valve 21 having "forward", "reverse", and "neutral" positions is rigidly secured to the top of reservoir 19. A control lever 22 for valve 21 is connected through a suitable control linkage 23 to a handle control 25 (FIG. 2). Hydraulic valve 21 controls a reversible hydraulic motor 24 such that motor 24 can either be caused to stop or rotate in either direction dependent on the position of valve 21 which in turn is positioned by the handle control 25.

The reversible hydraulic motor 24 is rigidly secured on a U-shaped support structure 30 which in turn rigidly secured to and centrally mounted on mounting plate 12. Motor 24 has a vertical drive shaft 31 extending downwardly therefrom through support structure 30 and integrally secured for rotation with an upper coupling 32. Upper coupling 32 in turn meshes with lower coupling 33 having a vertical downwardly extending shaft 34 integrally secured thereto and extending through mounting plate 12. A collar 35 surrounds shaft 34 and is integrally secured to bearing 36 which is in turn integrally secured to mounting plate 12. Thus, couplings 32, 33 drive shaft 34 which passes through collar 35, bearing 36 and plate 12.

A second bearing 37 is integrally secured by suitable means to the lower side of plate 12 and shaft 34 passes therethrough. A short U-plate 43 is slidably mounted on shaft 34 by means of a third bearing 44 which is integrally secured to the bottom side of plate 43. The internal sleeve 45 of bearing 44 has a short collar 46 welded thereto which in turn is welded to a surrounding hub 47 formed with integral, outwardly radiating arms 48. Another collar 49 with outwardly and downwardly radiating arms 50 is mounted on shaft 34 beneath hub 47. The purpose and use of arms 48 and 50 in conjunction with adjusting the blade tilt will become apparent from later description.

A sleeve 55 is rigidly secured to the lowermost end of shaft 34 and in turn a circular plate 56 is integrally secured to the bottom of sleeve 55 and shaft 34. Thus, as shaft 34 rotates, sleeve 55 and circular plate 56 rotate therewith. Tubular sleeves 57 mount on the upper surface of plate 56 and are welded to both sleeve 55 and plate 56 and extend radially outwardly from and perpendicular to the axis of shaft 34. Sleeves 57 receive shafts 58 in a rotatable relation. Grooves 59 on the inner ends of shafts 58 are positioned to align with holes 60 in sleeves 57 to receive bolts 61 in a sliding rotating relation to maintain longitudinal alignment of shafts 58. Rectangular bars 62 are integrally secured to shafts 58 and other rectangular bars 63 are secured to the bottom surfaces of bars 62 by welding. Bolts 64 serve to mount trowel blades 65 on the bottom surfaces of bars 63. Thus, it will be seen that as shafts 58 rotate within sleeves 57, blades 65 are also allowed to pivot in either direction corresponding to the rotation of the shafts 58.

Figure 7:
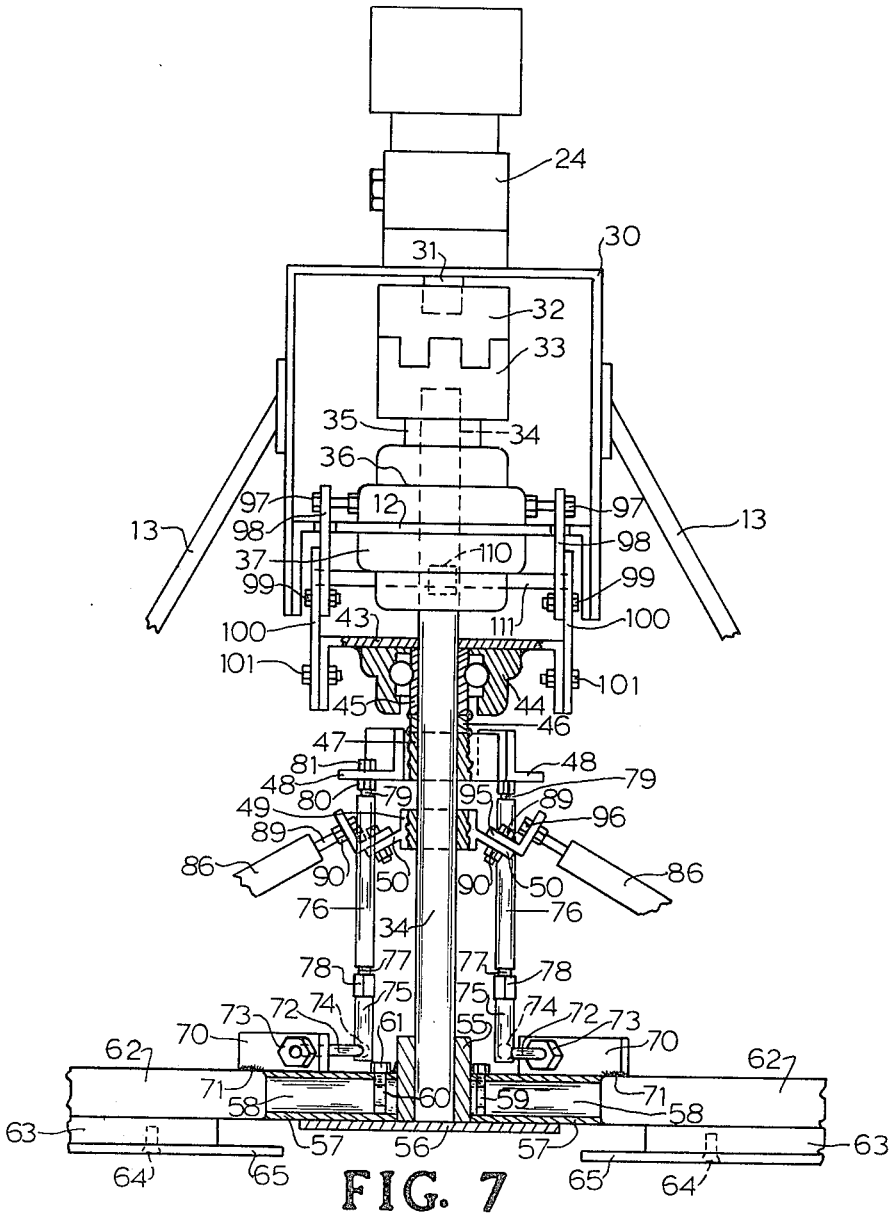
FIG. 7 is an enlarged fragmentary, section view taken substantially along line 7—7 of FIG. 1.
Figure 8:
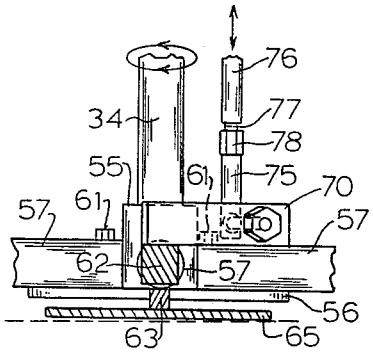
FIG. 8 is a fragmentary side elevation view of one trowel blade and its associated tilt mechanism with the trowel blade in a near horizontal position for float action.
Figure 9:
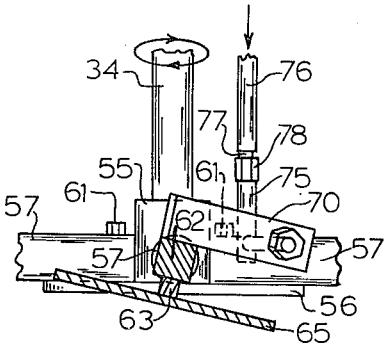
FIG. 9 is a view similar to that of FIG. 8 but with the blade titled by the tilting mechanism for a finish action and illustrating the drive shaft for the overall blade assembly being driven in a clockwise direction.
Figure 10:
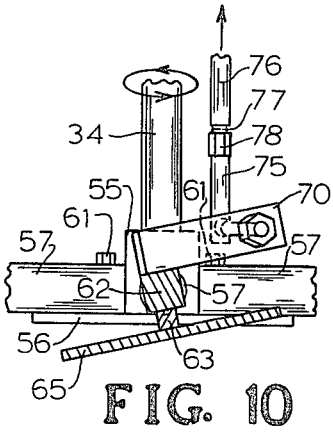
FIG. 10 is a view similar to that of FIG. 9 but with the blade tilted by the tilting mechanism so as to engage a blade edge with the work surface opposite from the blade edge shown in FIG. 9 engaging the work surface and further illustrating the drive shaft for the blade assembly being driven in an opposite or counterclockwise direction as compared to FIG. 9.

An important advantage of the invention is that the trowel blades can be adjusted to assume a floating action as in FIG. 8 or so as to assume a finishing action on one set of edges as in FIG. 9 or on the opposite set of edges as in FIG. 10. For the purpose of blade positioning, bars 62 have outwardly extending brackets 70 secured by welding 71 (FIG. 7). Rods 72 extend inwardly towards shaft 34 from brackets 70 and at one end are fixed to brackets 70 by nuts 73 and at the opposite end mount balls 74 which in turn reside within mating holes in lower connecting rods 75. Upper connector rods 76 connect to lower connector rods 75 through threaded sections 77 and nuts 78. Upper connector rods 76 have top threaded sections 79 which pass through nuts 80, through a portion of outwardly radiating arms 48 and are secured by nuts 81 which maintain rods 75, 76 in position. Individual connector rod adjustment can be accomplished by loosening or tightening the respective nut 78 on the corresponding threaded section 77. Each trowel blade 65 is associated with a similar tilting arrangement which through later described linkage enables the blades 65 to be tilted in either direction for finishing action or to be maintained nearly flat for floating action.

One of the problems encountered in use of any powered trowel apparatus is that one or more of the blades may unexpectedly strike an embedded pipe, reinforcing bar, or the like, which may misalign or bend a portion of the trowel blade support structure relative to other trowel blade support structure. The invention apparatus provides means for quickly making adjustments in the field as may be necessitated by unexpected accidents of this kind. In this regard, it will be noted that a pair of brackets 85 are integrally secured to the outer ends of bars 62 and by means of bolts 87 and nuts 88 pivotally mount the lower ends of brace bars 86. The upper ends of brace bars 86 have threaded bar portions 89 held in angles 95 by means of nuts 96. Angles 95 are in turn secured to arms 50 by suitable nut and bolt arrangement 90. In service, it will thus be noted that brace bars 86 can be individually adjusted by appropriate loosening and tightening of the respective nuts 90, 96 on the respective angle 95 and are effective to maintain the respective blade support bars 62 in a substantially level relation. As a further stiffening means, each bar 62 has an extension 66 welded to the outer ends thereof and by means of bolts 67 receive braces 68 in a pivotal manner. Braces 68 and stiffening bars 86 tend to resist any upward deflection of the outer ends of bars 62 and blades 65.

To continue the description of the blade tilting mechanism, it will be noted that upper bearing 36 is secured to mounting plate 12. Extending outwardly from opposed sides of bearing 36 are a pair of bolts 97, each of which pivotally mounts a dog-leg linkage member 98 having a lower dog-leg portion 98*a* extending rearwardly toward handle 15. A pivot point is situated centrally of each dog-leg member 98 and is established by a pair of bolts 99 which pivotally connect link members 100 to dog-leg members 98. Connecting members 100 are pivotally connected by bolts 101 to the downwardly turned portions of a small U-plate 43 which is, in turn, integrally secured to bearing 44 mounted on shaft 34. Thus, inward or outward movement of lower dog-leg members 98*a* causes bearing 44 to move upward or downward on shaft 34 to obtain the trowel blade tilting function of the invention.

Reference is next made to FIGS. 1 and 6–10 for further description of the blade tilting and control mechanism. As best seen in FIG. 6, it will be noted that control bar 110 is pivotally connected to the rearward end of lower dog-leg portions 98*a* by means of rod 111 which extends between the pair of dog-leg portions 98*a*. Also, extending rearwardly from mounting plate 12 toward handle 15 is a support bar 112 on the free end of which a half-moon plate 113 with peripheral teeth 114 is integrally secured. A bracket 115 is welded to bar 112 beneath plate 113 and mounts pin 117 for pivotal support of control handle 116, the lower end of which also supports pivot pin 118 mounting the outer end of control bar 110.

Bracket members 119, 120, 121 are welded to handle 116 and extend outwardly towards the vertical plane occupied by half-moon plate 113. Guide tube 122 is integrally secured to bracket members 120, 121 and serves as an alignment means and guide for adjustment rod 123 which extends upward through bracket member 121 and terminates in a handgrip portion 123*a*. The lower portion of rod 123 extends below bracket member 119 and mounts a coil spring 124 above tooth engagement member 125 on the lower end of rod 123 and which is designed to mate with selected teeth 114 on plate 113.

In order to tilt the blades 65 to a selected position, the operator grasps handgrip 116*a* of handle 116 and lifts up on rod portion 123*a* to disengage the tooth engagement member 125 from the teeth 114 of plate 113 and which allows handle 116 to be moved either forward or backward dependent upon the desired direction of tilt for blades 65. By moving handle 116 rearwardly, i.e., towards handle 15, control bar 110 is moved forward and through dog-leg linkage members 98, causes connecting link members 100 to move downward which in turn moves the U-plate 43 and bearing 44 downward on shaft 34. Since bearing 44, collar 46 and hub 47 are secured together, they also move in a downward direction. This downward movement is thereby directed to connector rods 76 and 75 which in turn effects a downward movement of brackets 70 and rotates bars 62 so that blades 65 assume the position of FIG. 9. This position is desirable when blades 65 are to be used for finishing the concrete. Also, it is important to note that in FIG. 9, shaft 34 is shown being rotated clockwise by hydraulic motor 24.

In another mode, handle 116 may be moved forward, i.e., towards engine 17, so as to cause bar 110 to be pulled towards handle 15 and through dog-leg linkage members 98 and connecting link members 100 to cause U-plate 43 and bearing 44 to be lifted upwardly on shaft 34. This action in turn would cause collar 46 and hub 47 to rise and in doing so, rods 76,75 would now raise brackets 70 and rotate bars 62 in a counterclockwise direction so as to tilt blades 65 in the position of FIG. 10. In this regard, it is particularly important to note that in FIG. 10 shaft 34 is illustrated as being rotated counterclockwise by reversible motor 24. Thus, the weight of the trowel would be supported on and the desired finishing action would be accomplished on the edges of trowel blades 65 opposite to the trowel blade edges employed in the illustration of FIG. 9. Thus, by being able to reverse the direction of rotation of motor 24 and simultaneously tilt the blades 65 as described, the blade life of blades 65 can be substantially extended since both edges of each blade are usable without having to remove the blades 65 for replacement or reverse their position on the support bars 63 as would otherwise be required with prior art apparatus. Also to be noted is that by appropriate positioning of handle 116, the blades 65 can be quickly placed in a near flat position for a floating action as depicted in FIG. 8. Alternatively, a "combination" type blade (FIG. 13) can be used.

Figure 11:
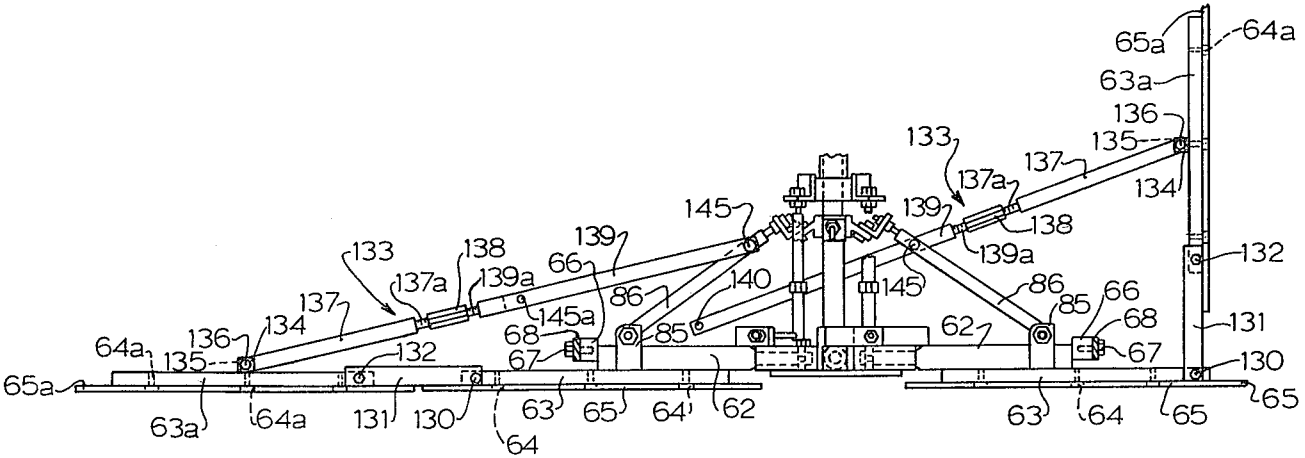
FIG. 11 is a fragmentary side elevation view similar to that of FIG. 3 but illustrating in a second embodiment a pair of trowel blades mounted on each support arm and with the support arm arranged for folding for ease of transport.

One of the advantages of using a powered trowel having only one set of blades is the fact that it can be easily moved from one job site to another job site and an ordinary pickup truck is frequently used for such transport. However, when this method of transport is employed, it is desirable that the trowel apparatus sit flat on the bed of the truck to avoid bending of the blades or blade support structure. Thus, the overall diameter of the blade rotor assembly is generally limited to the distance between the wheel wells which typically intrude and limit the available width of the truck bed. One of the advantages of the present invention, in an alternative embodiment, is that means are provided by which portions of the invention trowel apparatus can be folded during transport so that an overall larger blade arrangement can be employed in normal use of the trowel apparatus. This alternative embodiment is illustrated in FIG. 11 in which there is shown a tiltable blade arrangement mounting two blades 65, 65*a* on each tiltable arm. As in the first embodiment, each blade 65 is secured to the respective bar 63 by bolts 64. At the outer end of each bar 63 a hole is drilled to receive a bolt 130. A channel member 131 fits over the outer end of bar 63 and receives a bolt 130 secured by a nut, not shown, enabling channel member 131 to pivot on bolt 130. An additional set of outer blades 65*a* are mounted by bolts 64*a* on auxiliary outer bars 63*a* which act to extend the previously referred to bars 63. Bolts 132 pass through holes, not shown, in bars 63*a* and channel members 131 and are secured by nuts, not shown, so as to connect the respective channel members 131 and extension bars 63*a* as illustrated in FIG. 11. This arrangement thus provides on each blade support arm arrangement a pair of blades 65, 65*a* instead of a single blade 65 as in the first embodiment. Also, of particular importance to the embodiment illustrated in FIG. 11, it will be noted that the outer blades 65*a* can be pivoted about bolt 130 upwardly into a vertical position to facilitate transport.

Figure 12:
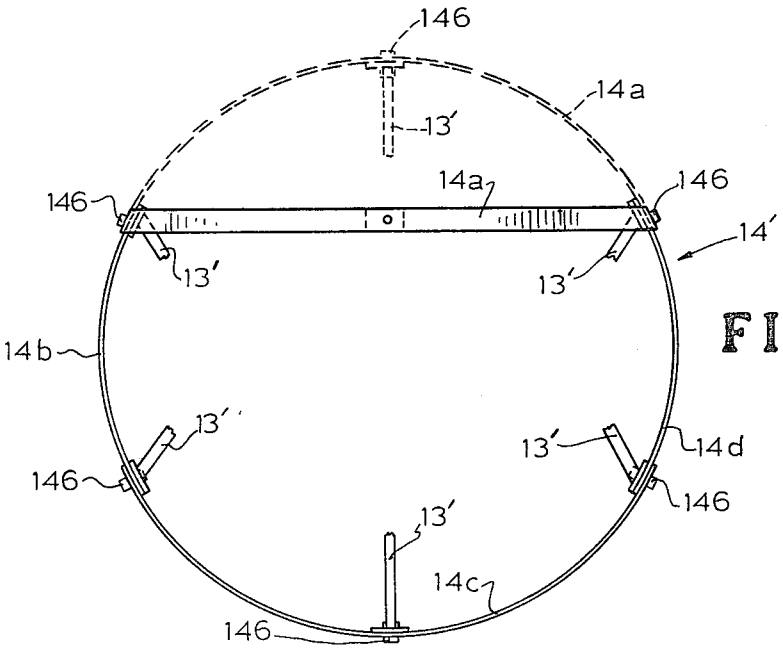
FIG. 12 is a top plan view of an alternative folding guard ring for use with the folding arm-trowel blade arrangement of FIG. 11.

Each blade 65*a* and its associated auxiliary bar 63*a* are maintained in a horizontal position by an adjustable stiffening arm 133. Stiffening arm 133 is pivotally secured to a respective auxiliary bar 63*a* having brackets 134 integrally secured thereto. Brackets 134 are U-shaped and receive ball joints 135 between the legs thereof with ball joints 135 being mounted on pivot pins 136. Each arm 137 is integrally secured to the respective ball joint 135 and includes an integral threaded extension 137*a* mounting a turnbuckle 138. Also threadably secured, by opposing threads, within each turnbuckle 138 is a second threaded extension 139*a* which is integral with an arm 139. Arm 139 is U-shaped with the base of the U being integral with extension 139*a* and the legs thereof extending inward towards connecting bars 86 so that the legs of each U-shaped arm 139 straddle the respective connecting bar 86. Each leg of arm 139 has a hole 140 adjacent the free end thereof and connecting bars 86 have mating holes, not shown, which receive bolts 145 passing through the respective legs of arms 139 and connecting arms 86 and which are held by nuts, not shown, in locked relation. Each blade 65*a* is thus maintained in a plane parallel to that of its associated blade 65 and each respective turnbuckle 138 may be individually adjusted to maintain this parallel relationship and also to maintain each respective stiffening arm 133 in position to maintain a downward pressure on the outer ends of the auxiliary blades 65*a*. The addition of auxiliary blades 65*a* allows the overall width of the trowel 10 to be increased so as to increase the amount of working surface engaged by the trowel blades in operation. However, as illustrated in FIGS. 11 and 12, the trowel structure of the alternative embodiment is easily folded such that the dimensions can be accommodated to the available bed width of a pickup truck for ease of transport. By removing bolts 145, blades 65*a* may be pivoted vertically to the position illustrated on the right hand side of FIG. 11 and can be held in this position by means of holes 145*a* formed in the respective arms 139 for receiving bolts 145 as best illustrated on the right hand side of FIG. 11.

Means are also provided for folding the guard ring 14 when using the double blade arrangement of FIG. 11. FIG. 12 illustrates an alternative guard rail 14' which is of sufficient diameter to afford protection for the use of auxiliary blades 65*a* but which may also be folded for transporting purposes. With this object in mind, ring 14' is made in segments 14*a*, 14*b*, 14*c*, 14*d*. Segments 14*a*, 14i b, 14*c*, 14*d* are joined by nut and bolt arrangements 146 and which also secure ribs 13' at their point of engagement with guard ring 14'. As best seen in FIG. 12, those nut and bolt arrangements connecting segment 14*a* to segments 14*b*, 14*d* may be loosened and segment 14*a* pivoted vertically to lessen the width of guard ring 14' and thus lessen the overall width of trowel 10 for transport purposes. In order to pivot segment 14*a*, *the nut and bolt arrangement 146 intermediate segment 14a* is removed. Segment 14*c* may also be pivoted in the same manner as segment 14*a* although not illustrated as such. The same procedure is followed, i.e., loosening nut and bolt arrangements 146 which connect segment 14*c* to segments 14*b*, 14*d* and by removing the nut and bolt arrangement 146 which is situated intermediate segment 14*c*. Thus, by so folding guard rail 14' and pivoting the auxiliary blades 65*a*, the trowel 10 may be quickly reduced in overall width and easily transported from job site to job site by pickup truck or another type of small bed truck.

In summary, the following advantages are all achieved by the powered trowel apparatus of the invention.

(a) The assembly of blades can be power driven in either direction around the vertical central axis of the drive shaft by utilizing the reversible hydraulic motor and associated control therefor.

(b) The blades themselves may be tilted in either direction around the horizontal axes on which they are supported so that the weight of the trowel can be supported on either set of blade edges for finishing action or on the flat blade surfaces for a floating action thereby enabling either a finishing action or a floating, near flat, action to be achieved and the blade wear to be distributed on both edges of each blade.

(c) For ease of transport, the invention provides a folding blade and blade support arm arrangement as well as a folding guard ring arrangement such that the invention trowel can be reduced in width for ease of transport on a truck having a narrow width bed such as a pickup truck.

(d) To compensate for normal wear as well as for misadjustments brought about by the blades or blade support arms unexpectedly striking an object such as a pipe, the invention also provides means enabling each blade support arm to be individually positioned so that the blade or blades supported on each such blade support arm can be positioned corresponding to the wear or damage associated with each such blade support arm.

(e) An overall well balanced powered trowel is achieved by means of offsetting the drive engine from its normal central position and balancing the weight of the offset engine by the weight of an oil reservoir associated with the hydraulic drive motor of the invention.

(f) The use of a reversible hydraulic drive motor provides both the advantage of being able to rotate the blades about a vertical drive axis in either direction and also provides a means by which the drive engine, i.e., the gasoline engine, can operate without turning the blades. That is, the hydraulic drive motor effectively acts as a drive device as well as a clutch device since the drive motor can be made inoperative by placing the hydraulic control in a "neutral" position in which all of the pressurized oil can be diverted.

(g) Blade tilting can be accomplished with the engine either stopped or running and with the drive motor either in neutral or operative for shaft rotation in either direction.

(h) The inherent characteristics of the fluid drive provide a cushioning effect for the drive mechanism and which protects the drive mechanism from damage in the event the blades strike hidden pipes, stakes, or the like.

(i) Additional compensation for wear and accidental damage is achieved by providing means by which the tilt linkage for each blade support arm can be individually adjusted.

Figure 14:
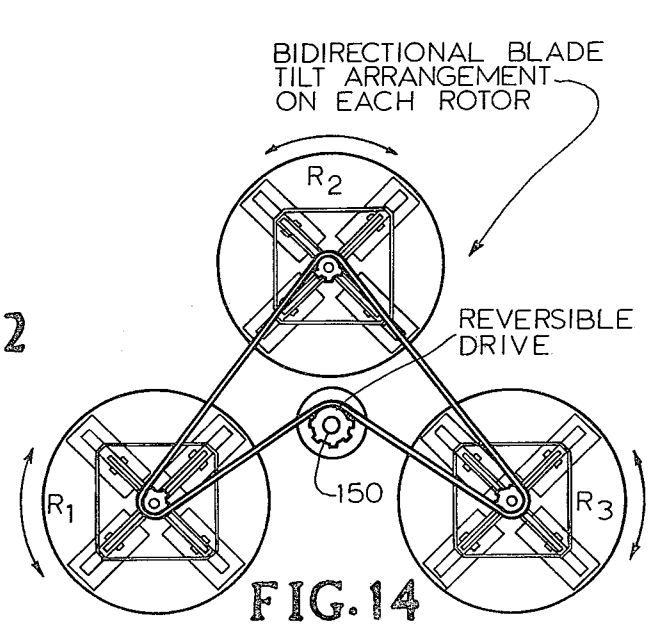
FIG. 14 illustrates the reversible drive feature of the invention as applied to a motor powered trowel having plural sets of trowel blades.

(j) The combined reversible tilt and reversible drive apparatus of the invention lends itself for use with either hand-guided powered trowel apparatus having a single set of blades as disclosed or powered trowel apparatus which is hand-guided or ridden and having plural sets of blades as schematically illustrated in FIG. 14.

(k) Employment of a so-called "combination" blade as seen in FIG. 13 also becomes practical so that the blades can be rotated in one direction and tilted to use one set of blade edges on a relatively narrow width blade for a finishing action or rotated in either direction with the blades nearly flat, i.e., very slightly tilted as in FIG. 8, to achieve a floating action.

(l) While not illustrated, it will also be recognized that the blades could be tilted by any of the already-known mechanical or hydraulic tilting mechanisms without losing any of the advantages of the reversible drive feature of the invention.

(m) The invention also recognizes both with respect to those types of motor-powered rotary trowels having one set of rotary blades as well as those having plural sets of rotary blades, that the ability to reverse direction also provides an ability to control the direction in which the trowel tends to move on the work surface.

From the foregoing, it can be seen that by providing a powered rotary trowel apparatus in which the blades can be tilted fully in either direction and can also be rotated in either direction, substantial economies are realized in blade cost as well as other operating requirements. An overall improved trowel is also achieved.

What is claimed is:

1. A concrete surface working apparatus comprising:

(a) a frame structure;

(b) a reversible, hydraulic motor mounted on said frame structure and having a vertical drive shaft;

(c) a gasoline driven engine, a hydraulic pump driven by said engine and an associated oil reservoir and hydraulic control all mounted on said frame structure and providing means for energizing and controlling said motor enabling said shaft to be caused to stop or be selectively driven in either direction;

(d) a plurality of radially arranged trowel blades having opposed parallel longitudinal working edges and tiltably mounted on support means arranged to be driven by said shaft, said motor, engine, hydraulic pump, oil reservoir and hydraulic control being mounted at elevated positions above said blades with said motor and shaft being above the center of said blades and with said engine and reservoir being disposed in a balanced relation on opposite sides of said motor; and (e) means mounted on said frame structure adapted for tilting the trowel blades in either direction about longitudinal axes and holding the blades on said support means in a selected tilted position whereby independent of the direction in which said shaft is driven the weight of said machine will be supported on and the finishing action of said blades will be accomplished by those edges of the blades which are trailing with respect to the direction of rotation of said shaft and blades.

2. An apparatus as claimed in claim 1 wherein said means for tilting said blades is operable during operation of said engine.

3. An apparatus as claimed in claim 1 wherein said blades comprise sets of plural radially arranged blades rotating about the vertical axis of said shaft with blade supporting and bracing structure adapted to be folded during transport of said apparatus.

4. An apparatus as claimed in claim 1 including at least one additional set of plural radially arranged and tiltably positionable trowel blades mounted for rotation about an axis laterally spaced from and parallel to the axis of said shaft and means to drive said additional set of blades with said motor in either direction in correspondence with the direction of rotation of said shaft.

5. An apparatus as claimed in claim 1 wherein said blades are rectangular in shape and are mounted such that the longitudinal axis about which said blades tilt are parallel to and offset from the central longitudinal axis of the blades whereby to achieve a "combination" blade effect.

6. An apparatus as claimed in claim 1 wherein said tilting means includes means enabling the degree of tilting for each said trowel blade to be individually adjusted and adjustable means for individually bracing each said trowel blade against upward deflection such that the tilting and positioning of each said blade can be individually adjusted to compensate for blade misalignment caused by wear and accidental damage to said apparatus.

7. A concrete surface working apparatus comprising:

(a) a frame structure;

(b) a reversible, hydraulic motor mounted on said frame structure and having a drive shaft;

(c) means mounted on said frame structure in a balanced relation and adapted for energizing and controlling said motor enabling said shaft to be caused to stop or be selectively driven in either direction;

(d) a plurality of radially arranged trowel blades mounted on said frame structure below said motor and motor energizing and controlling means and having opposed parallel longitudinal working edges and mounted on rotatable support means arranged to be driven by and around the axis of said shaft; and (e) means for holding the blades on said support means in a selected position whereby independent of the direction in which said shaft is driven the weight of said machine can be supported on and the action of said blades can be accomplished by selectively positioned surfaces of said blades.

* * * * *